US008145103B2

(12) United States Patent
Hazeyama et al.

(10) Patent No.: US 8,145,103 B2
(45) Date of Patent: Mar. 27, 2012

(54) IMAGE FORMATION DEVICE AND DEVELOPER SUPPLY DEVICE

(75) Inventors: Tomoaki Hazeyama, Mie (JP); Masataka Maeda, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 381 days.

(21) Appl. No.: 12/472,660

(22) Filed: May 27, 2009

(65) Prior Publication Data

US 2009/0297227 A1 Dec. 3, 2009

(30) Foreign Application Priority Data

May 27, 2008 (JP) ..... 2008-137988

(51) Int. Cl.
*G03G 15/08* (2006.01)

(52) U.S. Cl. ..... 399/266; 399/265; 399/291; 399/293

(58) Field of Classification Search ..... 399/265, 399/266, 289, 290, 291, 292, 293
See application file for complete search history.

(56) References Cited

U.S. PATENT DOCUMENTS

| | | | | |
|---|---|---|---|---|
| 4,558,941 | A * | 12/1985 | Nosaki et al. | 399/266 |
| 4,598,991 | A * | 7/1986 | Hosoya et al. | 399/266 |
| 6,597,884 | B2 * | 7/2003 | Miyaguchi et al. | 399/266 |
| 6,947,691 | B2 * | 9/2005 | Miyaguchi et al. | 399/266 |
| 2007/0147904 | A1 * | 6/2007 | Maeda | 399/265 |

FOREIGN PATENT DOCUMENTS

| | | |
|---|---|---|
| JP | 63-013073 | 1/1988 |
| JP | 63-013074 | 1/1988 |
| JP | 07-064390 | 3/1995 |
| JP | 2002-287495 | 10/2002 |
| JP | 2002-307740 | 10/2002 |
| JP | 2004-157259 | 6/2004 |
| JP | 2008-040043 | 2/2008 |
| JP | 2008-052027 | 3/2008 |
| JP | 2008-052034 | 3/2008 |
| JP | 2008-083237 | 4/2008 |

* cited by examiner

*Primary Examiner* — Sandra Brase
(74) *Attorney, Agent, or Firm* — Banner & Witcoff, Ltd.

(57) ABSTRACT

There is provided an image formation device including a developer holding body having a developer holding surface; and a developer supply unit to supply the developer to a position facing the developer holding surface by carrying the developer in a developer transport direction intersecting with the main scanning direction through use of effect of an electric field. The developer supply unit includes a plurality of carrying electrodes each of which is formed to have a longer side extending along the main scanning direction. The carrying electrodes are arranged along the developer transport direction to carry the developer when a drive voltage is applied to the carrying electrodes. The developer supply unit has a developer carrying area formed such that, in the main scanning direction, the developer carrying area becomes narrower from an upstream side in the developer transport direction toward the position along the developer transport direction.

20 Claims, 10 Drawing Sheets

IMAGE FORMATION DEVICE AND DEVELOPER SUPPLY DEVICE

CROSS-REFERENCE TO RELATED APPLICATION

This application claims priority under 35 U.S.C. §119 from Japanese Patent Application No. 2008-137988, filed on May 27, 2008. The entire subject matter of the application is incorporated herein by reference.

BACKGROUND

1. Technical Field

Aspects of the present invention relate to a developer supply device configured to carry charged developer through use of the effect of an electric field toward a developer holding body. Aspects of the present invention further relate to an image formation device provided with such a developer supply device.

2. Related Art

Developer supply devices configured to carry developer through use of the effect of an electric field have been widely used. Examples of such a developer supply device are disclosed in Japanese Patent Provisional Publications No. SHO 63-13073 (hereafter, referred to as JP SHO 63-13073A), No. SHO 63-13074 (hereafter, referred to as JP SHO 63-13074A), No. 2002-287495 (hereafter, referred to as JP 2002-287495A), No. 2002-307740 (hereafter, referred to as JP 2002-307740A), No. 2004-157259 (hereafter, referred to as JP 2004-157259A), No. 2008-40043 (hereafter, referred to as JP 2008-40043A), No. 2008-52027 (hereafter, referred to as JP 2008-52027A), No. 2008-52034 (hereafter, referred to as JP 2008-52034A), and No. 2008-83237 (hereafter, referred to as JP 2008-83237A).

The developer supply device disclosed in the above described publications is provided with a plurality of carrying electrodes arranged along a developer transport direction. In the developer supply device, a traveling electric field is produced by applying a drive voltage to the plurality of carrying electrodes, and the developer is carried by the effect of the traveling electric field.

SUMMARY

It is desired that an appropriate carrying condition of developer is achieved in the developer supply device so that an image having a suitable quality can be formed.

Aspects of the present invention are advantageous in that a developer supply device and an image formation device capable of achieving an appropriate carrying condition of developer are provided.

According to an aspect of the invention, there is provided an image formation device, comprising: a developer holding body having a developer holding surface which is configured to hold developer thereon and is located to be parallel with a main scanning direction; and a developer supply unit configured to supply the developer to a position facing the developer holding surface by carrying the developer in a developer transport direction intersecting with the main scanning direction through use of effect of an electric field. The developer supply unit comprises a plurality of carrying electrodes each of which is formed to have a longer side extending along the main scanning direction. The plurality of carrying electrodes is arranged along the developer transport direction to carry the developer when a drive voltage is applied to the plurality of carrying electrodes. The developer supply unit has a developer carrying area on which the developer is carried, and the developer carrying area is formed such that, in the main scanning direction, the developer carrying area becomes narrower from an upstream side in the developer transport direction toward the position along the developer transport direction.

Since the developer carrying area becomes narrower from an upstream side in the developer transport direction toward the position along the developer transport direction, the density of developer becomes higher at the facing position, and therefore the efficiency for supplying the developer to the developer holding surface can be enhanced. Consequently, the carrying condition of the developer can be enhanced and thereby an image having a suitable quality can be formed.

According to another aspect of the invention, there is provided a developer supply device, comprising: a developer carrying body configured to supply developer to a position facing a developer holding surface of a developer holding body which is configured to hold the developer thereon and is configured such that the developer holding surface is parallel with a main scanning direction, by carrying the developer in a developer transport direction intersecting with the main scanning direction through use of effect of an electric field; and a plurality of carrying electrodes each of which is formed to have a longer side extending along the main scanning direction. The plurality of carrying electrodes is arranged along the developer transport direction to carry the developer when a drive voltage is applied to the plurality of carrying electrode. The developer supply device has a developer carrying area on which the developer is carried, and the developer carrying area is formed such that, in the main scanning direction, the developer carrying area becomes narrower from an upstream side in the developer transport direction toward the position along the developer transport direction.

Since the developer carrying area becomes narrower from an upstream side in the developer transport direction toward position along the developer transport direction, the density of developer becomes higher at the facing position, and therefore the efficiency for supplying the developer to the developer holding surface can be enhanced. Consequently, the carrying condition of the developer can be enhanced and thereby an image having a suitable quality can be formed.

According to another aspect of the invention, there is provided a developer supply device, comprising: a plurality of carrying electrodes each of which is formed to extend in a first direction; and a developer holding area configured to include the plurality of carrying electrodes and to carry developer in a second direction substantially perpendicular to the first direction when a drive voltage is applied to the plurality of carrying electrodes, so as to supply the developer to a developer holding member which holds the carried developer. Further, the developer holding area has a portion where the developer holding area becomes narrower in the first direction from an upstream side in the second direction toward a downstream side in the second direction.

Since the developer holding area becomes narrower from an upstream side in the second direction toward the downstream side in the second direction, the efficiency for supplying the developer to the developer holding member can be enhanced. Consequently, the carrying condition of the developer can be enhanced and thereby an image having a suitable quality can be formed.

It is noted that various connections are set forth between elements in the following description. It is noted that these connections in general and unless specified otherwise, may be direct or indirect and that this specification is not intended to be limiting in this respect. Aspects of the invention may be implemented in computer software as programs storable on computer-readable media including but not limited to RAMs, ROMs, flash memory, EEPROMs, CD-media, DVD-media, temporary storage, hard disk drives, floppy drives, permanent storage, and the like.

BRIEF DESCRIPTION OF THE ACCOMPANYING DRAWINGS

DETAILED DESCRIPTION

Hereafter, an embodiment according to the invention will be described with reference to the accompanying drawings.

Figure 1:
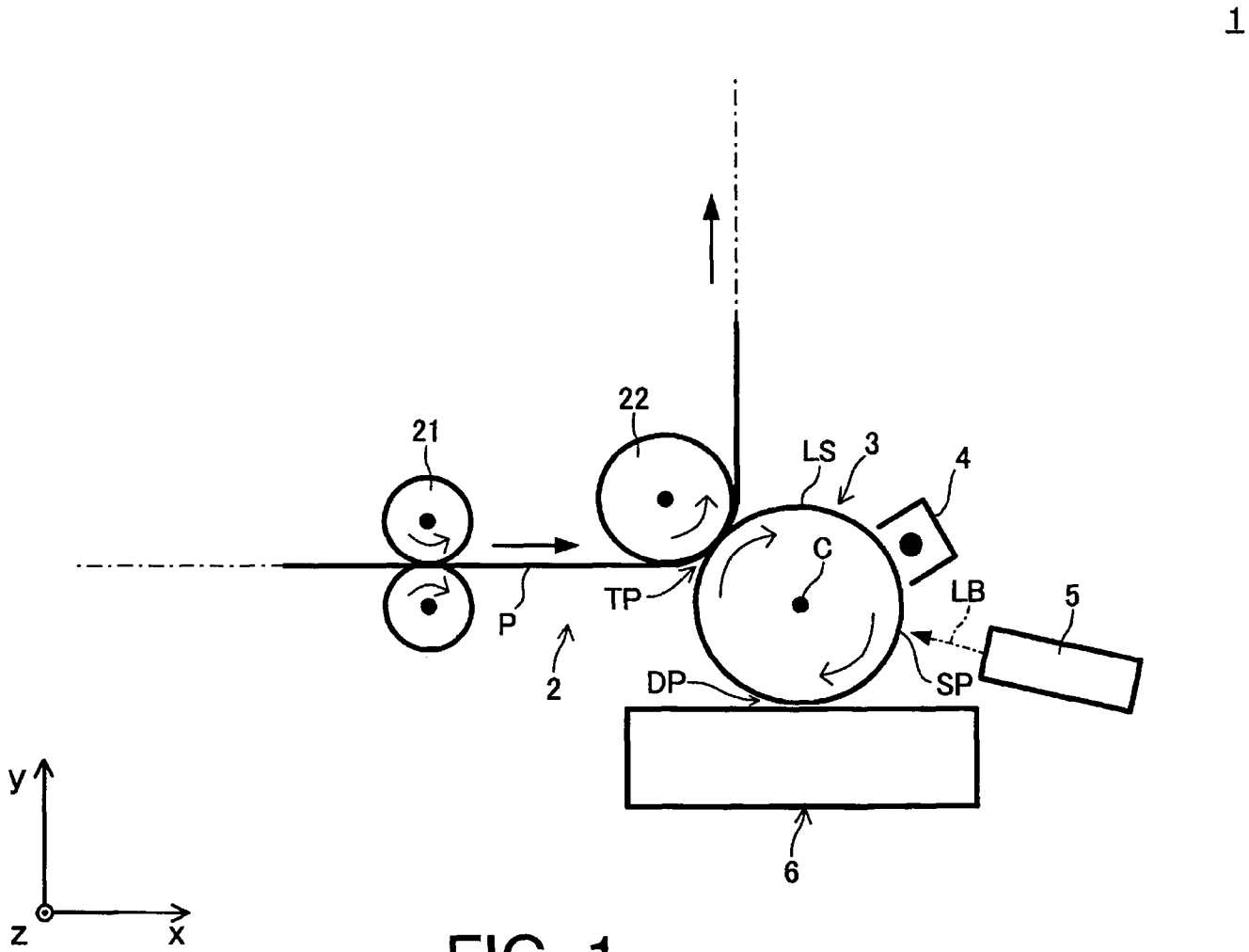
FIG. 1 illustrates a general configuration of a laser printer according to an embodiment.

FIG. 1 illustrates a general configuration of a laser printer 1 according to an embodiment. As shown in FIG. 1, the laser printer 1 includes a paper carrying unit 2, a photo sensitive drum 3, a charger 4, a scanning unit 5, and a toner supply unit 6. In a paper supply tray (not shown) provided in the laser printer 1, a stack of sheets of paper P is placed. The paper carrying unit 2 is configured to carry the sheet of paper P along a predetermined paper transport path.

The photosensitive drum 3 serves as a developer holding body. On an outer circumferential surface of the photosensitive drum, a latent image formation surface LS is formed. The latent image formation surface LS is formed to be a cylindrical surface extending in parallel with a main scanning direction (i.e., the z-axis direction on FIG. 1). On the latent image formation surface LS, a latent image is formed as a potential distribution. That is, toner is held at regions corresponding to the latent image on the latent image formation surface LS.

The photosensitive drum 3 is configured to be rotated in a rotational direction indicated by an arrow in FIG. 1 (i.e., in a clockwise direction in FIG. 1) about a center axis C which is parallel with the main scanning direction. Therefore, the latent image formation surface LS moves in a predetermined moving direction (i.e., an auxiliary scanning direction) which is perpendicular to the main scanning direction.

The charger 4 is positioned to face the latent image formation surface LS of the photo sensitive drum 3. The charger 4 is a scorotron or scorotron type charger. The charger 4 is configured to charge positively and uniformly the latent image formation surface LS.

The scanning unit 5 is configured to generate a laser beam B which is modulated in accordance with image data. That is, the scanning unit 5 generates the laser beam LB which is on/off modulated in accordance with presence/absence of pixel data and has a predetermined wavelength band. Further, the scanning unit 5 is configured to converge the laser beam LB at a scan position SP on the latent image formation surface LS. The scan position SP is located on the downstream side in the rotational direction (i.e., the clockwise direction in FIG. 1) of the photosensitive drum 3 with respect to the charger 4.

Further, the scanning unit 5 is configured to scan the laser beam LB, at the converged position, on the latent image formation surface LS in the main scanning direction at a constant speed, so that an electrostatic latent image is formed on the latent image formation surface LS.

The toner supply unit 6 serving as a developer supply device is located to face the photosensitive drum 3. The toner supply unit 6 supplies charged toner (i.e., dry type developer) to the latent image formation surface LS at a development position DP. The development position DP is a position at which the toner supply unit 6 faces the latent image formation surface LS. The toner supply unit 6 will be described in detail later.

Hereafter, a configuration of the laser printer 1 is explained.

A registration roller 21 is configured to send, at a predetermined timing, the sheet of paper P toward space between the photosensitive drum 3 and a transfer roller 22.

The transfer roller 22 is located to face the latent image formation surface LS (i.e., the outer surface) of the photosensitive drum 3 at a transfer position TP while sandwiching the sheet of paper between the photosensitive drum 3 and the transfer roller 22. The transfer roller 22 is rotated in the rotational direction (i.e., in the counterclockwise direction) indicated by an arrow in FIG. 1.

The transfer roller 22 is connected to a bias power circuit (not shown). That is, between the photosensitive drum 3 and the transfer roller 22, a predetermined transfer bias voltage for transferring the toner adhered to the latent image formation surface LS to the sheet of paper P is applied to the transfer roller 22.

Figure 2:
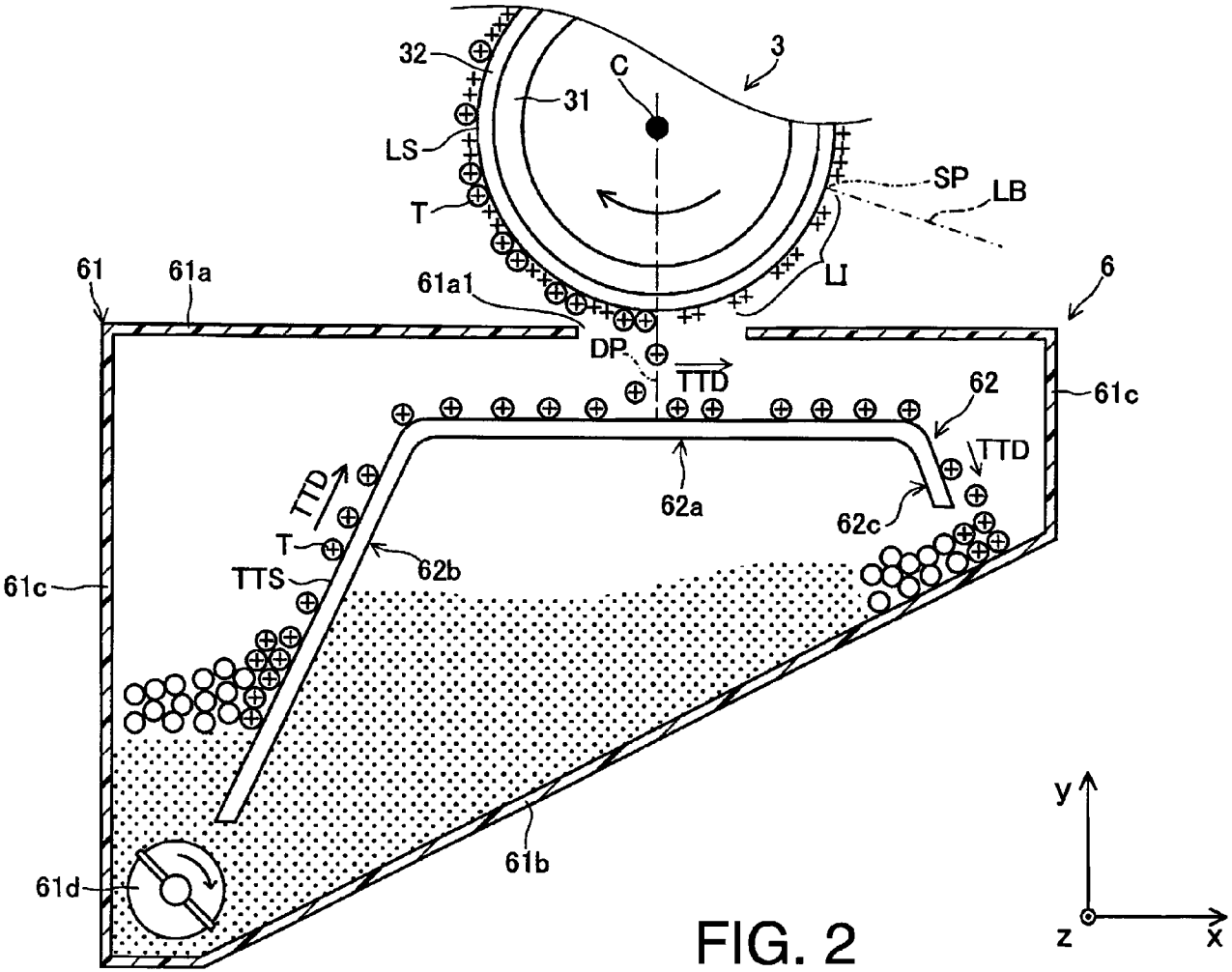
FIG. 2 is a side cross section illustrating a portion where a photosensitive drum and a toner supply unit face with each other.

FIG. 2 is a side cross section illustrating a portion where the photosensitive drum 3 and the toner supply unit 6 face with each other. As shown in FIG. 2, the photosensitive drum 3 includes a drum body 31 and a photosensitive layer 32.

The drum body 31 is a cylindrical member having the center axis C which is parallel with the z-axis. The drum body 31 is made of metal, such as aluminum. The drum body 31 is grounded. The photosensitive layer 31 is provided to cover the outer circumferential surface of the drum body 31. The photosensitive layer 32 includes a photo-conductive layer having a positive electrostatic property. That is, the photo-conductive layer exhibits a property of electronic conduction when receiving laser light having a predetermined wavelength.

The latent image formation surface LS is formed of the outer circumferential surface of the photosensitive drum 3. Therefore, when the laser beam LB scans at the scan position SP on the latent image formation surface LS after the latent image formation surface LS is charged positively and uniformly, an electrostatic latent image LI is formed on the latent image formation surface LS as a positively charged pattern.

The toner supply unit 6 carries the charged toner T in a predetermined toner transport direction TTD through use of the effect of an electric field to supply the toner T to the development position DP. More specifically, the toner supply unit 6 is configured as follows.

As shown in FIG. 2, the toner supply unit 6 has a box-shaped toner box 61 serving as a casing. The toner box 61 is configured to store the toner T which is fine grained developer of a dry type. In this embodiment, the toner T is a single-component nonmagnetic black developer having a positive electrostatic property.

A top plate 61*a* of the toner box 61 is located close to the photo sensitive drum 3. The top plate 61*a* is a plate-like rectangular member when viewed as a plan view, and is positioned horizontally.

A toner passage hole 61*a*1 is formed in the top plate 61*a*. Through the toner hole 61*a*1, the toner T moves from the inside of the toner box 61 toward the photosensitive surface 32 along the y-axis direction. The toner passage hole 61*a*1 has a rectangular shape having a longer side extending in the main scanning direction (i.e., the z-axis direction) to have the same width as that of the photosensitive layer 32 and a shorter side extending in the auxiliary scanning direction.

The toner passage hole 61*a*1 is located near the position where the top plate 61*a* is closest to the photosensitive layer 32. The tone passage hole 61*a*1 is positioned such that the center thereof in the auxiliary scanning direction (i.e., the x-axis direction) substantially coincides with the development position DP.

A bottom plate 61*b* of the toner box 61 is a plate-like member having a rectangular shape when viewed as a plan view, and is located under the top plate 61*a*. The bottom plate 61*b* is formed to be inclined such that the height in y-axis direction increases as a position in x-axis increases (see FIG. 2).

Four outer sides of the top plate 61*a* and the bottom plate 61*b* are surrounded by four side plates. In FIG. 2, only two side plates 61*c* and 61*c* of the four side plates are illustrated. By connecting integrally upper and lower edges of each of the four side plates 61*c* to the top plate 61*a* and the bottom plate 61*b*, the toner box 61 becomes able to store therein the toner T without causing the leakage of the toner T.

At the bottom portion of the toner box 61, a toner agitation unit 61*d* is provided. The toner agitation part 61*d* is configured to give fluidity (which fluid material has) to a cluster of the toner T by agitating the toner T stored in the toner box 61.

In this embodiment, the toner agitation unit 61*d* is formed of a rotator such as a bladed wheel rotatably supported by a pair of side plates 61*c* in the toner box 61.

A configuration for carrying the toner T through use of an electric filed will now be explained. In the toner box 61, a toner carrying body 62 is accommodated. The surface of the toner carrying body 62 is formed as a toner transport surface TTS on which the positively charged toner T is carried. The toner transport surface TTS is formed to be parallel with the main scanning direction (i.e., the z-axis direction). The toner transport surface TTS is formed to face the latent image formation surface LS at the position near the development position DP.

That is, the toner carrying body 62 is located such that the toner transport surface TTS is closest to the latent image formation surface LS at the development position DP. In other words, the toner carrying body 62 is located such that the position at which the toner transport surface TTS is closest to the latent image formation surface LS coincides with the development position DP.

The toner carrying body 62 is a plate-like member having a predetermined thickness. The toner carrying body 62 is configured to be able to carry the toner T in the toner transport direction TTD on the toner transport surface TTS. The toner transport direction TTD is a direction which is parallel with the toner transport surface TTS and is perpendicular to the main scanning direction. That is, the toner transport direction TTD is along the toner transport surface TTS and the auxiliary scanning direction.

The toner carrying body 62 includes a central part 62*a*, an upstream part 62*b* and a downstream part 62*c*.

The central part 62*a* is a plate-like part having a longer side extending in the main scanning direction to have the same length as the width of the photosensitive drum 3 in the main scanning direction, and a shorter side extending in parallel with the auxiliary scanning direction to have the length smaller than the diameter of the photosensitive drum 3. The central part 62*a* is formed to be a rectangular shape when viewed as a plan view. The central part 62*a* is located to be substantially parallel with the top plate 61*a* so as to face the latent image formation surface LS through the toner passage hole 61*a*1.

The upstream part 62*b* is a plate-like part, and is located on the upstream side in the toner transport direction with respect to the central part 62*a*. The upstream part 62*b* is formed to have an inclined surface which escalates gradually from the upstream edge toward the central part 62*a*. A lower edge (the most upstream edge) of the upstream part 62*b* is positioned close to the toner agitation unit 61*d*.

The downstream part 62*c* is a plate-like part, and is located on the downstream side in the toner transport direction TTD with respect to the central part 62*a*. The downstream part 62*c* is formed to decline as a point thereon moves away from the central part 62*a*. A lower edge (the most downstream edge) of the downstream part 62*c* is positioned close to the bottom plate 61*b*.

Figure 3:
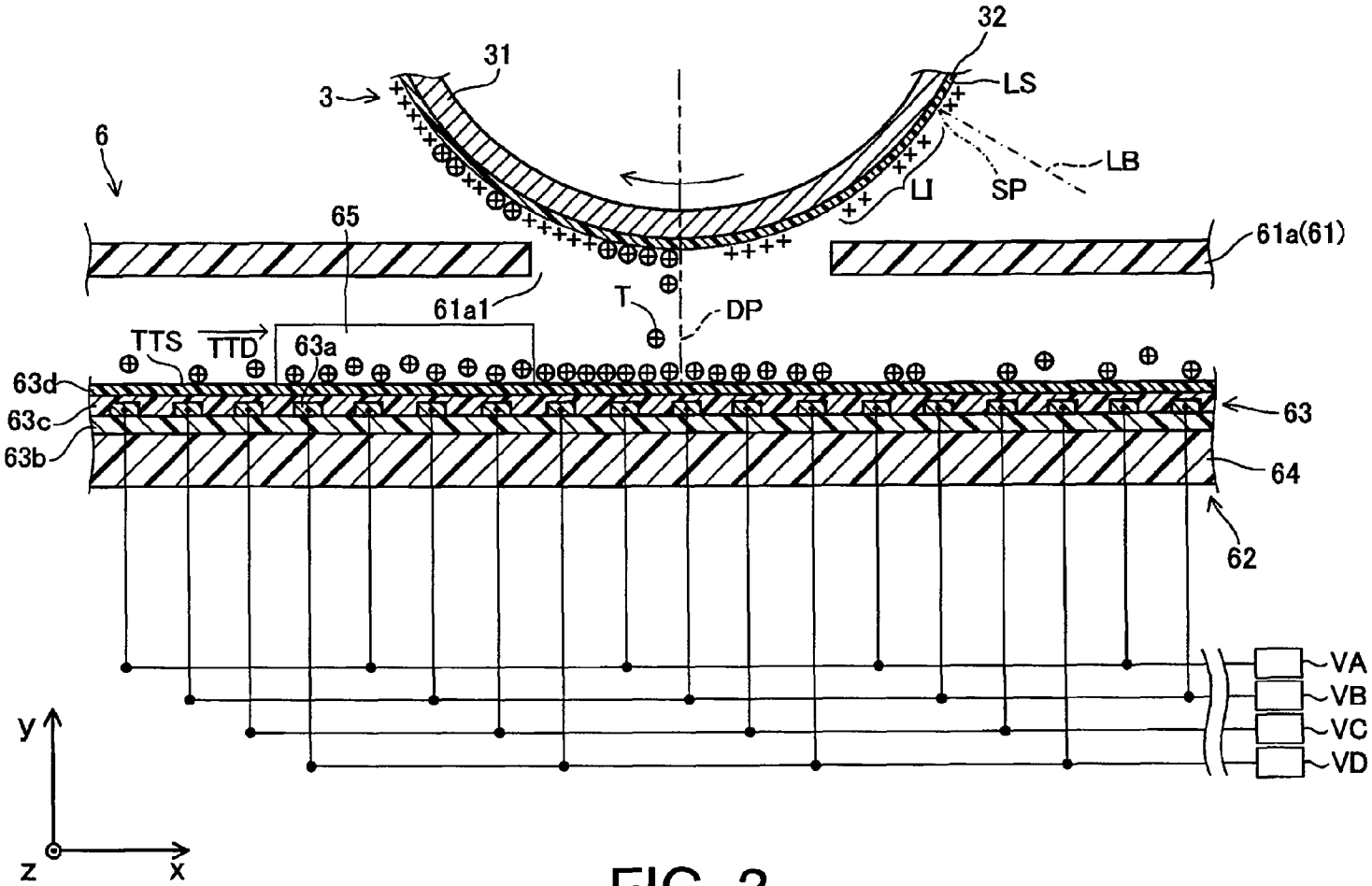
FIG. 3 is an enlarged cross section illustrating a portion around a development position in the toner supply unit.

FIG. 3 is an enlarged cross section illustrating a portion around the development position DP in the toner supply unit 6. As shown in FIG. 3, the toner carrying body 62 includes a carrying substrate 63. The carrying substrate 63 is located to face the latent image formation surface LS while sandwiching the top plate 61*a* and the toner passage hole 61*a*1 of the toner box 61 between the carrying substrate 63 and the latent image formation surface LS.

The carrying substrate 63 is a thin plate-like member, and has a structure similar to a flexible printed circuit. More specifically, the carrying substrate 63 includes a plurality of carrying electrodes 63*a*, a support film 63*b*, a coating layer 63*c*, and an overcoating layer 63*d*. The carrying substrate 63 is supported by a plate-like supporting member 64.

Each of carrying electrodes 63*a* is formed to be a linear pattern whose longitudinal direction is parallel with the main scanning direction. That is, the carrying electrode 63*a* is copper foil having a thickness of approximately several tens of micrometers. The plurality of carrying electrodes 63*a* are arranged to be parallel with each other. The carrying electrodes 63*a* are aligned along the toner transport direction TTD (i.e., the auxiliary scanning direction).

The carrying electrodes 63*a* are arranged on the toner transport surface TTS. That is, each carrying electrode 63*a* is positioned close to the toner transport surface TTS. The carrying electrodes 63*a* which are aligned in the auxiliary scanning direction are connected to the same power circuit in the interval of four carrying electrodes 63*a*. That is, the carrying electrode 63*a* connected to a power circuit VA, the carrying electrode 63*a* connected to a power circuit VB, the carrying electrode 63*a* connected to a power circuit VC, and the carrying electrode 63*a* connected to a power circuit VD are repeated along the auxiliary scanning direction.

Figure 4:
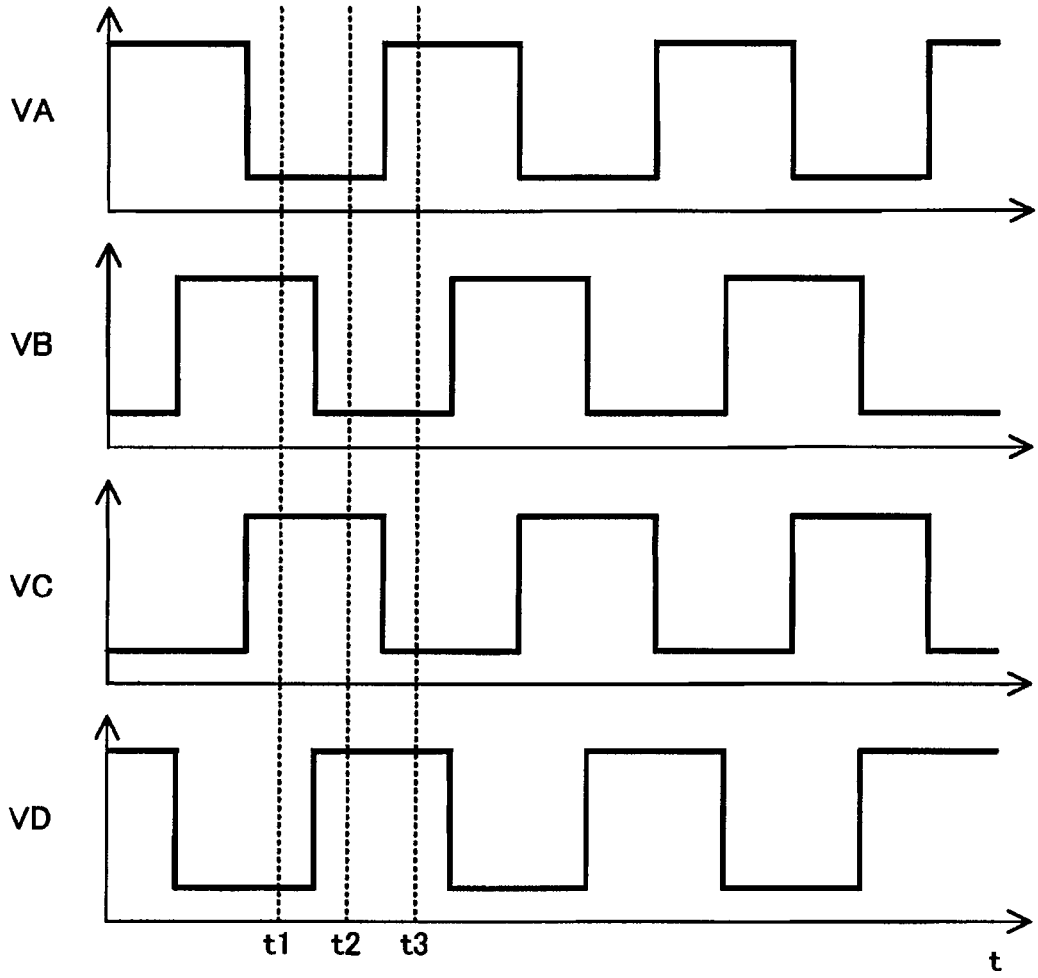
FIG. 4 is a timing chart illustrating waveforms of output signals from four power circuits.

FIG. 4 is a timing chart illustrating waveforms of output signals from the power circuits VA, VB, VC and VD. As shown in FIG. 4, the power circuits VA, VB, VC and VD output alternating voltage signals having substantially the same waveform, but the phases of the output signals of the power circuits VA, VB, VC and VD shift by 90 degrees with respect to each other. That is, in the order of the power circuits VA, VB, VC and VD, the phase of the next output voltage delays by 90 degrees from the phase of the previous output voltage.

By applying the above described drive voltage to the carrying electrodes 63*a* to produce a traveling electric field along the auxiliary scanning direction, the carrying substrate 63 becomes possible to carry the positively charged toner T in the toner transport direction TTD.

The carrying electrodes 63*a* are formed on the support film 63*b*. The support film 63*b* is an elastic film made of insulative resin, such as polyimide.

The coating layer 63*c* is made of insulative resin. The coating layer 63*c* is provided to cover the electrodes 63*a* and the surface of the support film 63*b* on which the electrodes 63*a* are formed.

The overcoating layer 63*d* is formed on the coating layer 63*c*. That is, the coating layer 63*c* is formed between the overcoating layer 63*d* and the electrodes 63*a*.

The toner transport surface TTS is formed as the surface of the overcoating layer 63*d*, and is formed to be a flat surface without bumps and dips.

Figure 5:
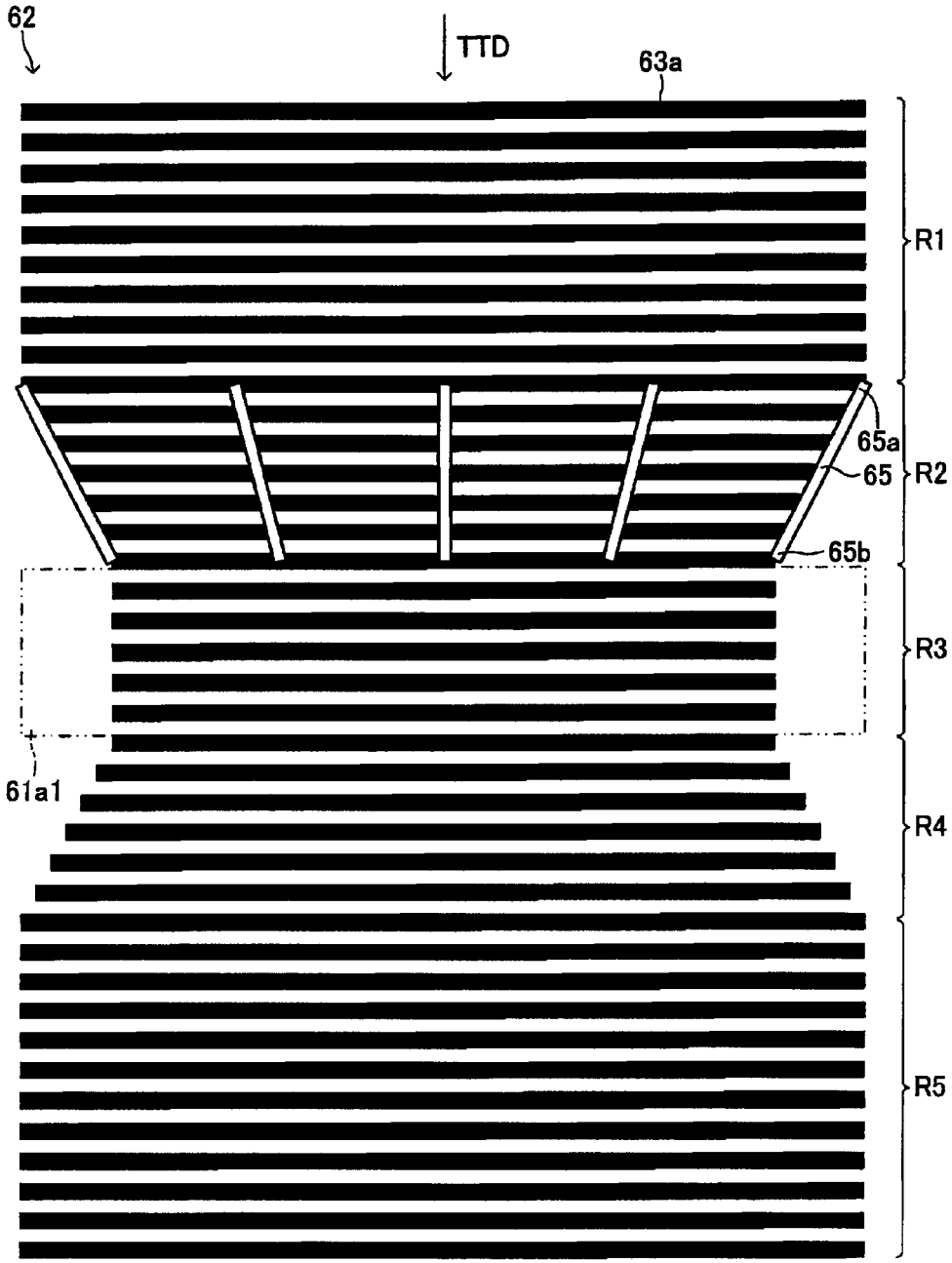
FIG. 5 illustrates a first example of a toner carrying body viewed as a partial plan view.

FIG. 5 illustrates a first example of the toner carrying body 62 viewed as a partial plan view. As shown in FIGS. 3 and 5, the toner carrying body 62 is configured such that, from the upstream side toward the development position DP, the width of a toner carrying area in the main scanning direction becomes narrower from the upstream side toward the development position DP.

More specifically, regarding the length in the main scanning direction, the electrodes 63*a* are formed as follows.

(1) In an upstream area R1 (including the upstream part 62*b* shown in FIG. 2) in the toner carrying direction TTD, the lengths of the electrodes 63*a* are substantially equal to each other.

(2) In an upstream transition area R2 defined on the downstream side of the upstream area R1 and on the upstream side of the toner passage hole 61*a*1, the lengths of the electrodes 63*a* become narrower from the upstream side toward the development position DP.

(3) In a facing area R3 which is defined on the downstream side of the upstream transition area R2 and at which the toner carrying body 62 faces the toner passage hole 61*a*1, the lengths of the electrodes 63*a* are kept constant.

As shown in FIG. 5, the toner carrying body 62 has a plurality of guide plates 65 (i.e., five guide plates in the example shown in FIG. 5). Each guide plate 65 is formed to protrude from the toner transport surface TTS. The guide plates 65 are provided such that the interval between adjacent upstream side edges 65*a* (i.e., upstream edges in the toner transport direction TTD) is larger than the interval between adjacent downstream edges 65*b* (i.e., downstream edges in the toner transport direction TTD). Furthermore, the guide plates 65 are formed such that the intervals between adjacent ones of the upstream edges 65*a* are equal to each other and the intervals between adjacent ones of the downstream edges 65*b* are equal to each other.

The toner carrying body 62 is configured such that the width of the toner carrying area in the main scanning direction becomes larger from the development position DP toward the downstream side in the toner transport direction TTD.

More specifically, regarding the length in the main scanning direction, the electrodes 63*a* are formed as follows.

(4) In a downstream transition area R4 defined on the downstream side of the facing area R3, the lengths of the electrodes 63*a* become larger from the development position DP toward the downstream side.

(5) In a downstream area R5 (including the downstream part 62*c* shown in FIG. 2) defined on the downstream side of the downstream transition area R4 in the toner carrying direction TTD, the lengths of the electrodes 63*a* are substantially equal to each other.

Hereafter, a print process in the laser printer 1 is explained.

As shown in FIG. 1, the leading edge of the sheet of paper P which is one of the stacked sheets of paper is carried to the registration roller 21. The registration roller 21 corrects skew of the sheet of paper P, and adjusts the carrying timing. Then, the sheet of paper P is carried to the transfer position TP.

While the sheet of paper P is carried toward the transfer position TP, a toner image is held on the latent image formation surface LS as follows.

First, the latent image formation surface LS of the photosensitive drum 3 is charged positively and uniformly by the charger 4. The latent image formation surface LS charged by the charger 4 moves to the scan position SP by rotation in the direction (i.e., in the clockwise direction) indicated by the arrow shown in FIG. 1. That is, the latent image formation surface LS moves, in the auxiliary scanning direction, to the scan position SP where the latent image formation surface LS faces the scanning unit 5.

At the scan position SP, the laser beam LB on/off modulated in accordance with the image data scans on the latent image formation surface LS in the main scanning direction. In accordance with the modulation of the laser beam LB, parts of the positive charges on the latent image formation surface LS disappear. As a result, a pattern of positive charges is formed on the latent image formation surface LS as an electrostatic latent image.

The electrostatic latent image LI formed on the latent image formation surface LS moves to the development position DP facing the toner supply unit 6 by rotation of the photosensitive drum 3 in the direction indicated by the arrow shown in FIG. 1 (i.e., in the clockwise direction).

As shown in FIG. 2, the toner T stored in the toner box 61 is fluidized by the toner agitation unit 61*d*. More specifically, the bladed wheel of the toner agitation unit 61*d* rotates in the direction indicated by the arrow in FIG. 2 (i.e., in the clockwise direction).

Through the motion of the toner agitation unit 61*d*, the friction is caused between the toner T and the toner transport surface TTS (i.e., the surface of the overcoating layer 63*d* made of synthetic resin) in the upstream part 62*b*. As a result, the toner is positively charged.

As described above, the upstream edge of the toner carrying body 62 in the toner transport direction TTD is sunk in the stored toner T. Therefore, the toner T stored in the toner box 61 is continuously supplied to the toner transport surface TTS on the upstream part 62*b*.

The traveling drive voltage is supplied to the plurality of electrodes 63*a* on the toner carrying body 62. Consequently, a traveling electric filed is produced on the toner transport surface TTS. By the effect of the traveling electric field, the positively charged toner T is carried on the toner transport surface TTS in the toner transport direction TTD.

Figure 6A:
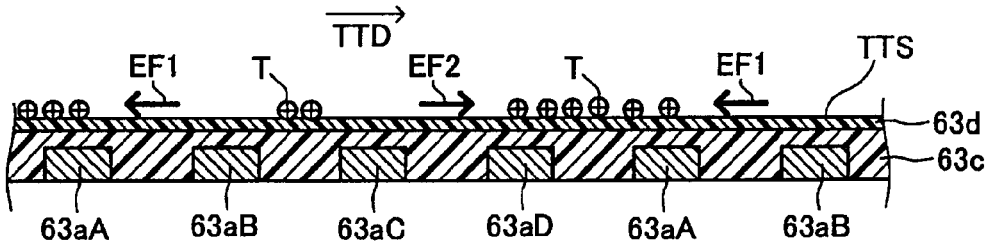
FIGS. 6A, 6B and 6C are cross sectional views illustrating a region around a toner transport surface of a toner carrying substrate.
Figure 6B:
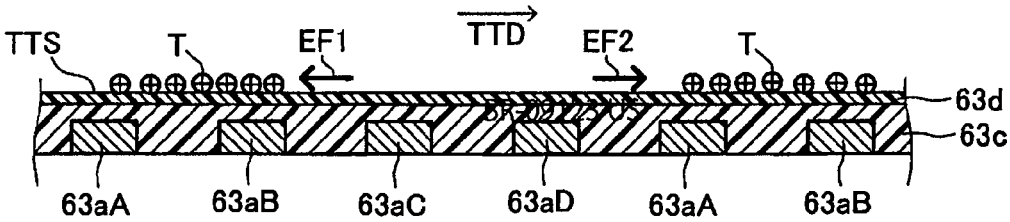
Figure 6C:
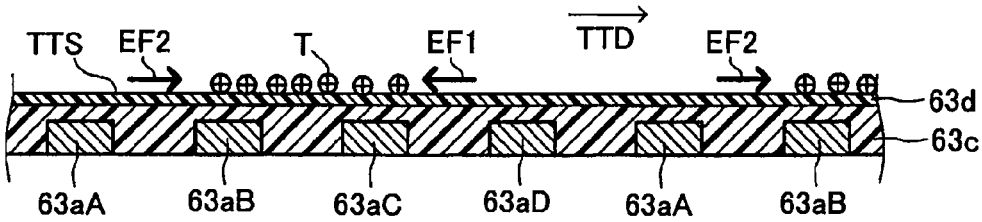

FIGS. 6A to 6C are cross sectional views illustrating in detail the region around the toner transport surface of the toner carrying substrate 63. In FIGS. 6A to 6C, the electrodes 63*a* connected to the power circuit VA are assigned numeric references 63*a*A, the electrodes 63*a* connected to the power circuit VB are assigned numeric references 63*a*B, the electrodes 63*a* connected to the power circuit VC are assigned numeric references 63*a*C, and the electrodes 63*a* connected to the power circuit VD are assigned numeric references 63*a*D.

Hereafter, the carrying motion of the toner T on the toner transport surface TTS in the toner transport direction TTD is explained with reference to FIGS. 4 and 6A to 6C.

As shown in FIG. 4, the alternating voltages having substantially the same waveform are outputted from the power circuits VA, VB, VC and VD such that the phases thereof are shift from each other by 90 degrees.

At a time t1 in FIG. 4, an electric filed EF1 having a direction opposite to the toner transport direction TTD is produced between the carrying electrode 63*a*A and 63*a*B (hereafter, simply referred to as "between the positions A and B"). At this time, an electric field EF2 having a same direction as the toner transport direction TTD is produced between the carrying electrode 63*a*C and the carrying electrode 63*a*D (hereafter, simply referred to as "between the positions C and D"). Between the carrying electrode 63*a*B and the carrying electrode 63*a*C (hereafter, simply referred to as "between the positions B and C") and between the carrying electrode 63*a*D and the carrying electrode 63*a*A (hereafter, simply referred to as "between the positions D and A"), no electric field is produced along the toner transport direction TTD.

That is, as shown in FIG. 6A, at the time t1, the positively charged toner T receives an electrostatic force in the direction opposite to the toner transport direction TTD between the positions A and B. Between the positions B and C and between the positions D and A, almost no electrostatic field is applied to the toner T along the toner transport direction TTD. Between the positions C and D, the electrostatic force having the same direction as the toner transport direction TTD is applied to the toner T. Therefore, at the time t1, the positively charged toner T is collected between the positions D and A.

It is understood, from the above described explanation, at a time t2 the positively charged toner T is collected between the positions A and B as shown in FIG. 6B. Then, as shown in FIG. 6C, at a time t3, the positively charged toner T is collected between the positions B and C.

Consequently, the region where the toner T is collected moves along the toner transport direction TTD on the toner transport surface TTS with time.

As described above, by applying the drive voltage shown in FIG. 4 to the toner carrying body 62, the traveling electric field is produced on the toner transport surface TTS. As a result, the positively charged toner T is carried along the toner transport direction TTD while hopping in the y-axis direction.

As shown in FIG. 3, through the above described toner carrying process, the positively charged toner T is supplied to the development position DP.

In the vicinity of the development position DP, the electrostatic latent image LI formed on the latent image formation surface LS is developed by the toner T. That is, on the latent image formation surface LS, the toner T adheres to the electrostatic latent image LI at portions where the positive charges disappear. Consequently, an image of toner (hereafter, referred to as a toner image) is held on the latent image formation surface LS.

As shown in FIG. 1, the toner image held on the latent image formation surface LS is carried to the transfer position TP by rotation of the latent image formation surface LS in the direction (i.e., in the clockwise direction) indicated by the arrow shown in FIG. 1. Then, the toner image is transferred from the latent image formation surface LS to the sheet of paper P at the transfer position TP.

The widths of the electrodes 63*a* in the main scanning direction are defined as described above and the guide plates 65 are arranged as described above. Therefore, according to the embodiment, the width of the toner carrying area for the toner T in the main scanning direction becomes narrower from the upstream side in the toner transport direction TTD toward the development position.

In this case, the density of the toner T becomes higher around the development position DP. That is, the density of the toner T in a development area where the electrostatic latent image LI is developed by the toner T (i.e., in the facing area R3) becomes higher than a supplying area (i.e., the upstream area R1 and the upstream transition area R2) for supplying the toner T to the development area. At this time, in the development area, the toner T rises highly. Consequently, it becomes possible to supply the toner T to the latent image formation surface LS more effectively. That is, the efficiency for supplying toner to the latent image formation surface LS can be enhanced.

Furthermore, according to the embodiment, the width of the toner carrying area in the main scanning direction becomes larger from the development position DP toward the downstream side. Therefore, it becomes possible to prevent occurrence of clogging and coagulation of the toner T.

Therefore, according to the embodiment, the toner T can be carried appropriately.

Although the present invention has been described in considerable detail with reference to certain preferred embodiments thereof, other embodiments are possible.

For example, the feature of the above described embodiment may be applied to various types of image formation devices employing an electrophotographic process, such as a color laser printer or a monochrome or color facsimile device.

The structure of the photosensitive body is not limited to the drum shape employed in the above described embodiment. For example, a plate-like photosensitive body or an endless belt type photosensitive body may be used.

The light source for exposing the photosensitive body is not limited to the laser scanning unit shown in the above described embodiment. Various types of light sources for exposing the photosensitive body, such as an LED, an EL (electroluminescence) device or a fluorescent device may be employed.

The feature of the above described embodiment may be applied to image formation devices other than the electrophotographic type. For example, the feature of the above described embodiment may be applied to various types of image formation devices employing print processes, such as toner jet printing, ion flow printing, and multi-stylus printing.

Figure 7:
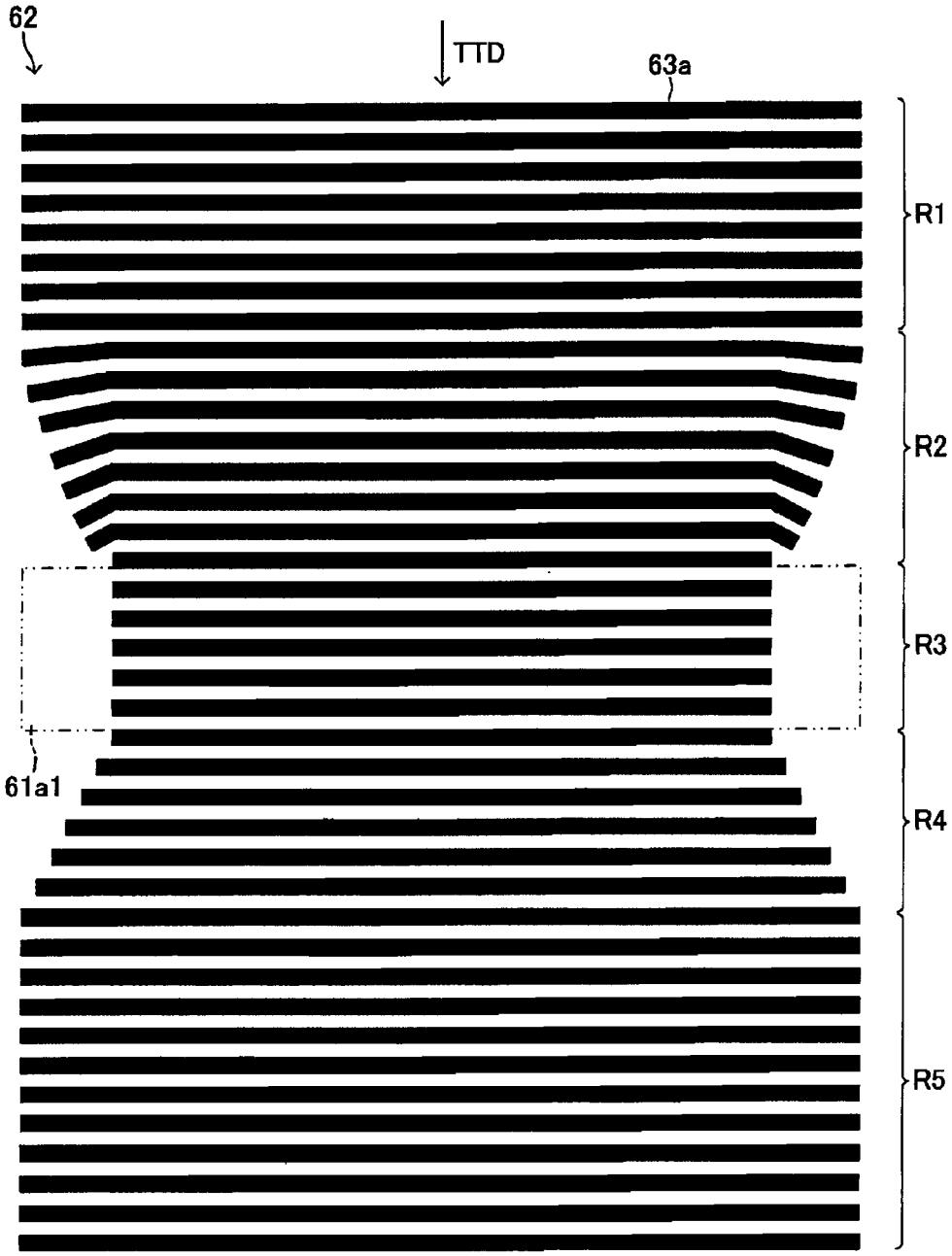
FIG. 7 is a plan view illustrating a second example of the toner carrying body.
Figure 8:
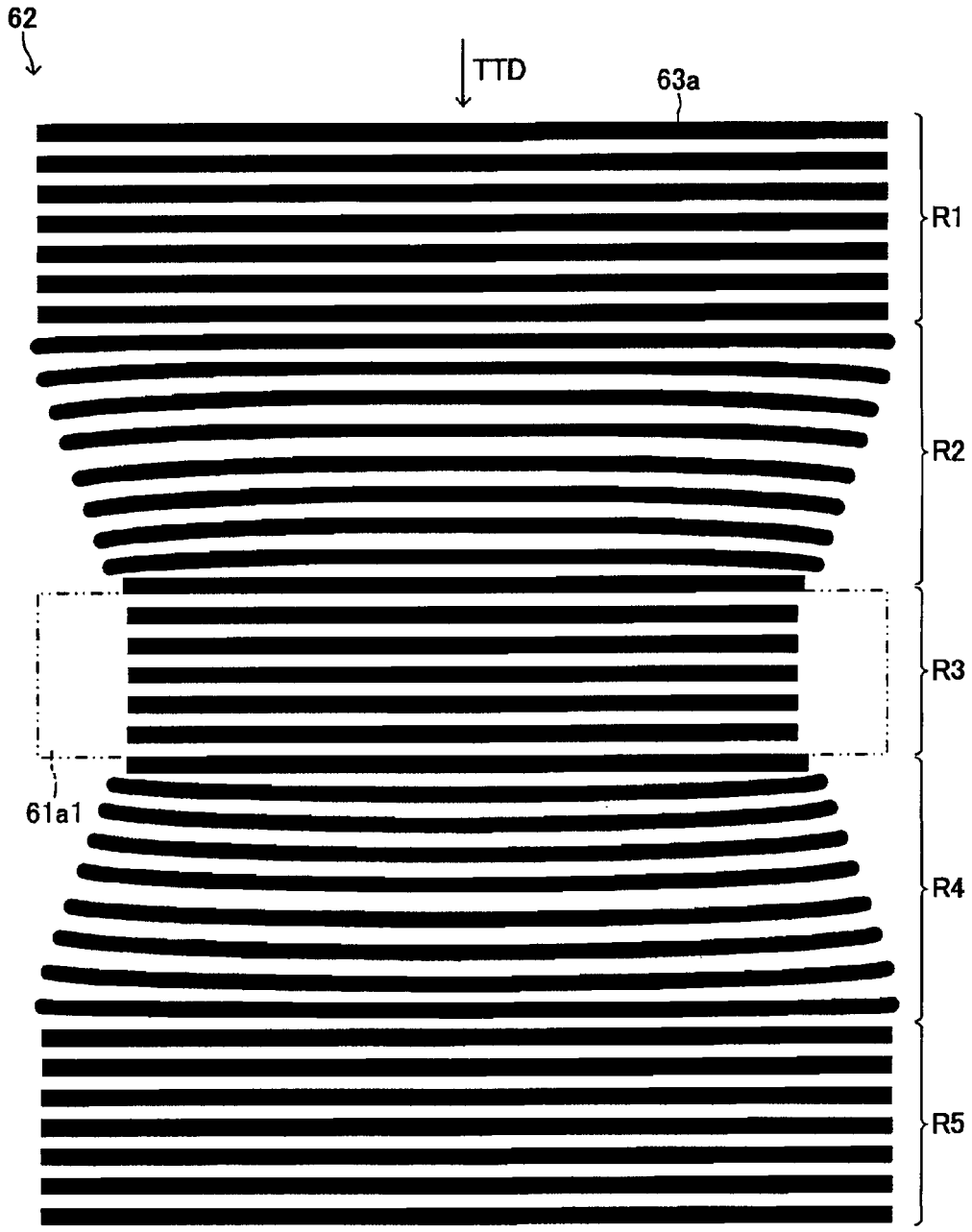
FIG. 8 is a plan view illustrating a third example of the toner carrying body.

FIGS. 7 and 8 are plan views illustrating second and third examples of the toner carrying body 62. In each of FIGS. 7 and 8, the guide plates 65 are omitted for the sake of simplicity.

As shown in FIGS. 7 and 8, the electrodes 63*a* near the facing area R3 in the upstream transition area R2 are configured to have a recessed shape opened toward the development position DP when viewed as a plan view.

More specifically, as shown in FIG. 7, in the upstream transition area R2, each electrode 63*a* is formed such that each end portion in the main scanning direction bends toward the side of the development position DP. It is preferable that the degree of bending of the end portion of the electrode increases from the upstream side toward the facing area R3 although the degree of bending may be kept constant from the upstream side toward the facing area R3.

In the upstream transition area R2, the center part of each electrode 63*a* extending linearly in the main scanning direction may have the same length as the length of the electrode 63*a* in the facing area R3.

In the example shown in FIG. 8, the carrying electrode 63*a* in the upstream transition area R2 is formed to have a shape of an arc. As shown in FIG. 8, it is preferable that the curvature of the arc shape of the carrying electrode 63*a* becomes larger from the upstream side toward the facing area R3. For example, the plurality of carrying electrodes 63*a* in the upstream transition area R2 may be formed concentrically.

Figure 9:
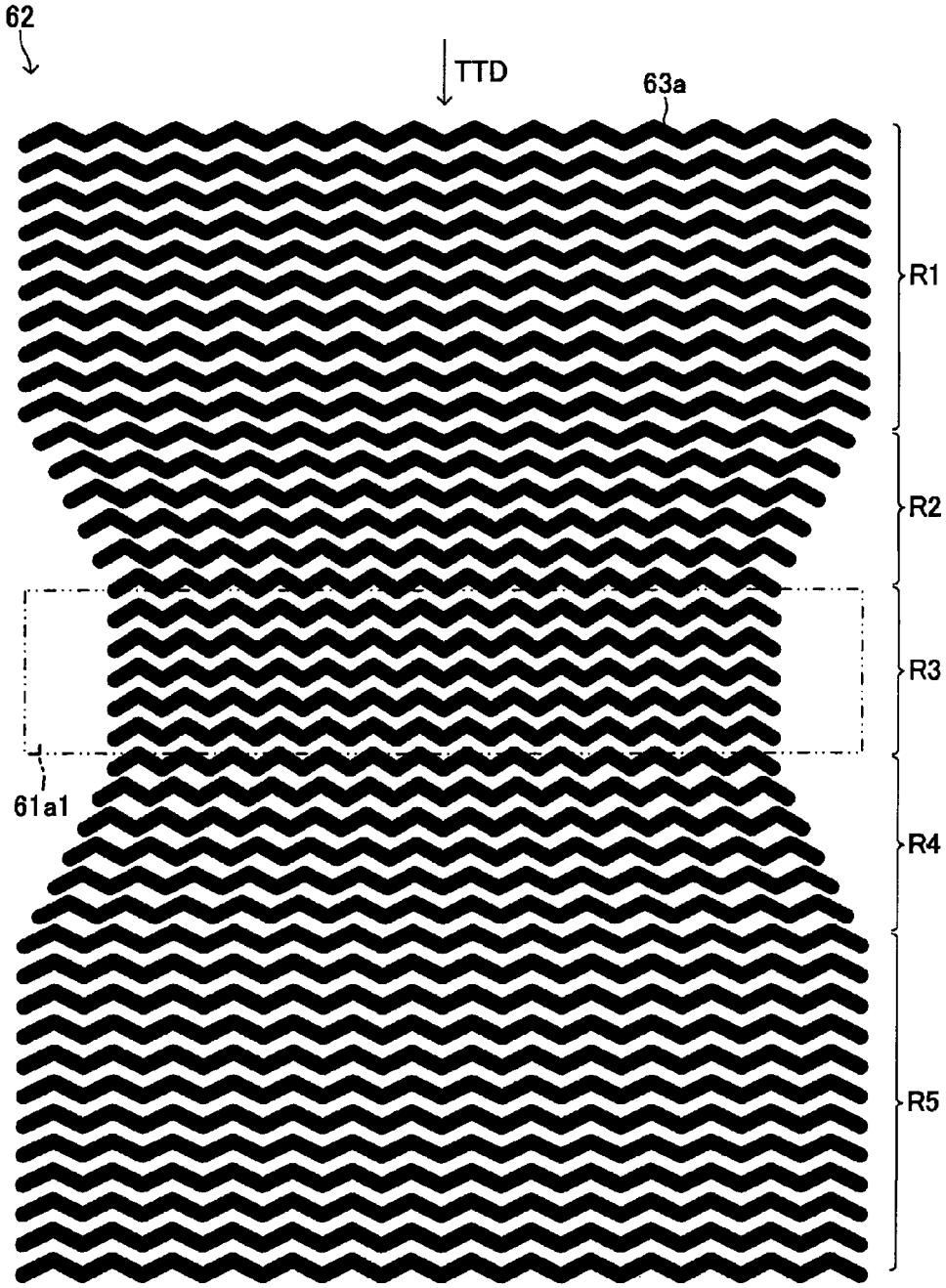
FIG. 9 is a plan view illustrating a forth example of the toner carrying body.

FIG. 9 is a plan view illustrating a forth example of the toner carrying body 62. The inventors of the present invention have confirmed the motion of the toner T by a computer simulation as indicated below.

When each carrying electrode 63*a* has a liner shape as shown in FIG. 5, the number of toner particles whose motion is substantially confined by the carrying substrate 63 is limited. In this case, parts of the toner particles exceeding the limited number rise and fly over the toner transport surface TTS.

On the other hand, if each carrying electrode 63*a* is formed to have a triangular waveform when viewed as a plan view, an electrostatic force in the main scanning direction acts on the toner T. Therefore, the density distribution of the toner T is produced in accordance with the shape of each carrying electrode 63*a* in the main scanning direction. In this case, the toner T (i.e., toner particles) rises highly at a portion where the toner density is relatively high.

From the above described fact, by forming the carrying electrode to have a triangular waveform and by forming the width of the toner carrying area in the main scanning direction to become narrower from the upstream side toward the development position DP along the toner transport direction TTD, it becomes possible to enhance the efficiency for supplying toner to the latent image formation surface LS.

Figure 10A:
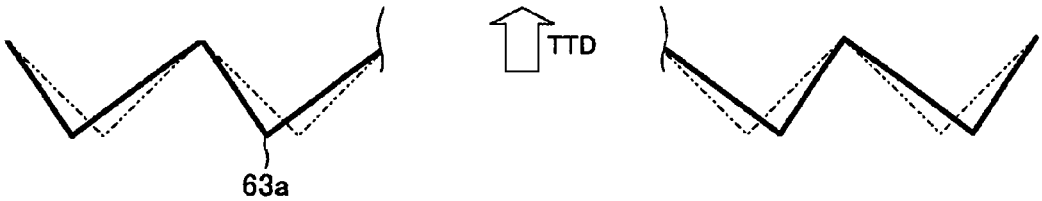
FIG. 10A is a partial enlarged view of a variation of a shape of a carrying electrode shown in FIG. 9.

Regarding each triangular shape in the triangular waveform of the carrying electrode 63*a* shown in FIG. 9, each triangular shape may be equal to an isosceles triangle as shown in FIG. 9, or may be a non-isosceles triangle as shown in FIG. 10A. In FIG. 10A, the isosceles triangle shape equal to the shape shown in FIG. 9 is indicated by an imaginary line (a two dot chain line).

More specifically, in the example shown in FIG. 10A, the triangular waveform of the carrying electrode 63*a* is formed such that each corner on the upstream side in the toner transport direction TTD is shifted toward the outer side in the longitudinal direction (i.e., the main scanning direction). In this case, the shifting amounts of the corners in the longitudinal direction may be equal to each other, or may become larger from the center toward the outside. It is understood that in this case the triangular shape gets closer to an isosceles triangle at a portion nearer to the center of the carrying electrode 63*a*, and therefore the triangular shape at the center portion is substantial equal to an isosceles triangle.

Figure 10B:
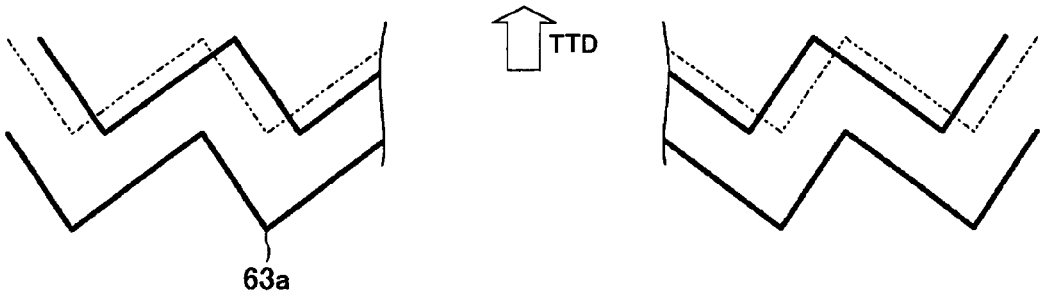
FIG. 10B is a partial enlarged view of another variation of the shape of the carrying electrode shown in FIG. 9.
Figure 10C:
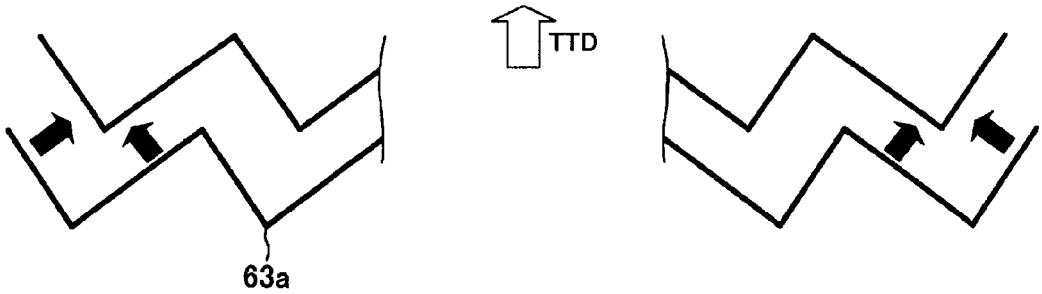
FIG. 10C is an explanatory illustration for explaining a state of an electric field produced by the carrying electrode shown in FIG. 10B.

As shown in FIG. 10B, the triangular waveforms of the carrying electrodes 63*a* may be formed such that the triangular waveform on the downstream side shifts inward in the longitudinal direction (i.e., the inward offset amount of the waveform in the longitudinal direction becomes larger from the upstream side toward downstream side in the toner transport direction TTD). In FIG. 10B, the waveform not offset is indicated by a dotted line. In this case, as shown in FIG. 10C, a carrying electric field which draws the toner inward is produced as indicated by black bold arrows in FIG. 10C, and the carrying electric field becomes larger from the upstream side toward the downstream side in the toner transport direction TTD.

The waveform of the carrying electrode viewed as a plan view may be altered as follows. For example, a corner of each triangular shape in the waveform may be rounded, the waveform may have a combined shape of a plurality of triangular waveforms (i.e., a sawtooth shape), or waveforms other than the triangular waveform (e.g., a sine waveform, a waveform formed by connecting a plurality of arcs) may be employed as the waveform of the carrying electrode 63*a*. It should be understood that the advantages of the above described embodiment can also be achieved even if the waveform of the carrying electrode is altered as described above.

In the above described embodiment, the guide plates 65 are provided on the toner carrying body 62. However, in another embodiment, the guide plates 65 may be omitted. Even if the guide plates 65 are omitted, substantially the same advantages as those of the above described embodiment can be achieved by the effect of the configuration of the carrying electrodes 53*a*.

The structure of the carrying substrate 63 is not limited to that shown in the above described embodiment. For example, the overcoating layer 63*d* may be omitted. Each carrying electrode 63*a* may be buried in the support film 63*b*. In this case, the coating layer 63*c* and the overcoating layer 63*d* can be omitted.

In the above described embodiment, the output voltage of each of the power circuits VA-VD has a rectangular shape. However, the output voltage of each of the power circuits VA-VD may have a shape of a sine waveform or a triangular waveform.

In the above described embodiment, four power circuits are provided, and the output voltages of the power circuits are defined such that the phases of the output voltages shift by 90 degrees with respect to each other. However, the number of power circuits is not limited to that shown in the above described embodiment. For example, the number of power circuits may be three, and the phases of the output voltages of the three power circuits may shift by 120 degrees with respect to each other.

What is claimed is:

1. An image formation device, comprising:

a developer holding body having a developer holding surface which is configured to hold developer thereon and is located to be parallel with a main scanning direction; and a developer supply unit configured to supply the developer to a position facing the developer holding surface by carrying the developer in a developer transport direction intersecting with the main scanning direction through use of effect of an electric field, the developer supply unit comprising a plurality of carrying electrodes each of which is formed to have a longer side extending along the main scanning direction, the plurality of carrying electrodes being arranged along the developer transport direction to carry the developer when a drive voltage is applied to the plurality of carrying electrodes, wherein the developer supply unit has a developer carrying area on which the developer is carried, and the developer carrying area is formed such that, in the main scanning direction, the developer carrying area becomes narrower from an upstream side in the developer transport direction toward the position along the developer transport direction.

2. The image formation device according to claim 1, wherein the plurality of carrying electrodes is formed such that in the main scanning direction, widths of the plurality of carrying electrodes become narrower from the upstream side in the developer transport direction toward the position along the developer transport direction.

3. The image formation device according to claim 1, wherein each of the plurality of carrying electrodes is formed to have a triangular waveform when viewed in a plan view.

4. The image formation device according to claim 1, wherein:

the developer supply unit comprises a plurality of guide plates each of which is formed to protrude from a developer carrying surface which faces the developer holding surface of the developer holding body and on which the developer is carried; and the plurality of guide plates is arranged such that an interval between adjacent upstream edges of the plurality of guide plates in the developer transport direction is larger than an interval between adjacent downstream edges of the plurality of guide plates in the developer transport direction.

5. The image formation device according to claim 4, wherein:

the number of the plurality of guide plates is three or more; and the plurality of guide plates is formed such that intervals between adjacent ones of the upstream edges are equal to each other and intervals between adjacent ones of the downstream edges are equal to each other.

6. The image formation device according to claim 1, wherein the developer carrying area is formed such that, in the main scanning direction, the developer carrying area becomes wider from the position toward a downstream side in the developer transport direction.

7. The image formation device according to claim 1, wherein in the vicinity of the position, the plurality of carrying electrodes includes carrying electrodes each of which is configured to have a recessed shape opened toward the position when viewed in a plan view.

8. A developer supply device, comprising:

a developer carrying body configured to supply developer to a position facing a developer holding surface of a developer holding body which is configured to hold the developer thereon and is configured such that the developer holding surface is parallel with a main scanning direction, by carrying the developer in a developer transport direction intersecting with the main scanning direction through use of effect of an electric field; and a plurality of carrying electrodes each of which is formed to have a longer side extending along the main scanning direction, the plurality of carrying electrodes being arranged along the developer transport direction to carry the developer when a drive voltage is applied to the plurality of carrying electrodes, wherein the developer supply device has a developer carrying area on which the developer is carried, and the developer carrying area is formed such that, in the main scanning direction, the developer carrying area becomes narrower from an upstream side in the developer transport direction toward the position along the developer transport direction.

9. The developer supply device according to claim 8, wherein the plurality of carrying electrodes is formed such that in the main scanning direction, widths of the plurality of carrying electrodes become narrower from the upstream side in the developer transport direction toward the position along the developer transport direction.

10. The developer supply device according to claim 8, wherein each of the plurality of carrying electrodes is formed to have a triangular waveform when viewed in a plan view.

11. The developer supply device according to claim 8, further comprising a plurality of guide plates each of which is formed to protrude from a developer carrying surface which faces the developer holding surface of the developer holding body and on which the developer is carried, wherein the plurality of guide plates is arranged such that an interval between adjacent upstream edges of the plurality of guide plates in the developer transport direction is larger than an interval between adjacent downstream edges of the plurality of guide plates in the developer transport direction.

12. The developer supply device according to claim 11, wherein:

the number of the plurality of guide plates is three or more; and the plurality of guide plates is formed such that intervals between adjacent ones of the upstream edges are equal to each other and intervals between adjacent ones of the downstream edges are equal to each other.

13. The developer supply device according to claim 8, wherein the developer carrying area is formed such that, in the main scanning direction, the developer carrying area becomes wider from the position toward a downstream side in the developer transport direction.

14. The developer supply device according to claim 8, wherein in the vicinity of the position, the plurality of carrying electrodes includes carrying electrodes each of which is configured to have a recessed shape opened toward the position when viewed in a plan view.

15. A developer supply device, comprising:

a plurality of carrying electrodes each of which is formed to extend in a first direction; and a developer holding area configured to include the plurality of carrying electrodes and to carry developer in a second direction substantially perpendicular to the first direction when a drive voltage is applied to the plurality of carrying electrodes, so as to supply the developer to a developer holding member which holds the carried developer, wherein the developer holding area has a portion where the developer holding area becomes narrower in the first direction from an upstream side in the second direction toward a downstream side in the second direction.

16. The developer supply device according to claim 15, wherein the developer holding area is formed to have a narrowest portion at a position facing the developer holding member.

17. The developer supply device according to claim 16, wherein the plurality of carrying electrodes is formed such that widths of the plurality of carrying electrodes in the first direction become narrower from the upstream side in the second direction toward the position along the second direction.

18. The developer supply device according to claim 15, wherein each of the plurality of carrying electrodes is formed to have a triangular waveform when viewed in a plan view.

19. The developer supply device according to claim 15, further comprising a plurality of guide plates each of which is formed to protrude from a developer carrying surface which faces a developer holding surface of the developer holding member and on which the developer is carried, wherein the plurality of guide plates is arranged such that an interval between adjacent upstream edges of the plurality of guide plates in the second direction is larger than an interval between adjacent downstream edges of the plurality of guide plates in the second direction.

20. The developer supply device according to claim 19, wherein:

the number of the plurality of guide plates is three or more; and the plurality of guide plates is formed such that intervals between adjacent ones of the upstream edges are equal to each other and intervals between adjacent ones of the downstream edges are equal to each other.

* * * * *